US006427651B1

(12) United States Patent
Kemper et al.

(10) Patent No.: US 6,427,651 B1
(45) Date of Patent: Aug. 6, 2002

(54) METHOD FOR CONTROLLING THE FINAL POSITION OF A GAS EXCHANGE VALVE ACTUATED BY AN ELECTROMAGNETIC ACTUATOR IN AN INTERNAL COMBUSTION PISTON ENGINE

(75) Inventors: Hans Kemper; Christian Boie, both of Aachen (DE)

(73) Assignee: FEV Motorentechnik GmbH, Aachen (DE)

( * ) Notice: Subject to any disclaimer, the term of this patent is extended or adjusted under 35 U.S.C. 154(b) by 0 days.

(21) Appl. No.: 09/744,694

(22) PCT Filed: May 25, 2000

(86) PCT No.: PCT/EP00/04772

§ 371 (c)(1),
(2), (4) Date: Jan. 29, 2001

(87) PCT Pub. No.: WO00/73635

PCT Pub. Date: Dec. 7, 2000

(30) Foreign Application Priority Data

May 27, 1999 (DE) ..... 199 24 374
Apr. 20, 2000 (DE) ..... 100 19 739

(51) Int. Cl.[7] ..... F01L 9/04

(52) U.S. Cl. ..... 123/90.11; 251/129.01; 251/129.16

(58) Field of Search ..... 123/90.11; 251/129.01, 251/129.05, 129.1, 129.15, 129.16

(56) References Cited

U.S. PATENT DOCUMENTS 5,671,705 A * 9/1997 Matsumoto et al. ..... 123/90.11
5,799,630 A * 9/1998 Moriya et al. ..... 123/90.11
5,868,108 A * 2/1999 Schmitz et al. ..... 123/90.11

FOREIGN PATENT DOCUMENTS

| | | |
|---|---|---|
| DE | 36 11 221 | 11/1986 |
| DE | 196 51 846 | 6/1998 |
| DE | 297 03 585 | 8/1998 |
| DE | 298 04 549 | 8/1998 |
| DE | 197 23 405 | 12/1998 |

* cited by examiner

*Primary Examiner*—Weilun Lo
(74) *Attorney, Agent, or Firm*—Venable; Gabor J. Kelemen

(57) ABSTRACT

A method for controlling an electromagnetic actuator operating a gas exchange valve in an internal combustion piston engine. Between two electromagnets an armature, connected to the gas exchange valve, is reciprocated by a return spring between the electromagnets whose alternating energization moves the valve into open and closed positions. The lift of the armature is detected by a sensor array during its movement from one pole face to the other. Depending on the detected actual values of the armature lift, the energy flow to the electromagnets is controlled such that the armature moves at a speed tending to zero at a predetermined distance range from the pole face of the capturing electromagnet. At the end of the lift motion, the current flow through the capturing electromagnet is guided in such a way that the armature is maintained oscillating at a short distance from the pole face of the capturing electromagnet.

3 Claims, 3 Drawing Sheets

Figure 1:
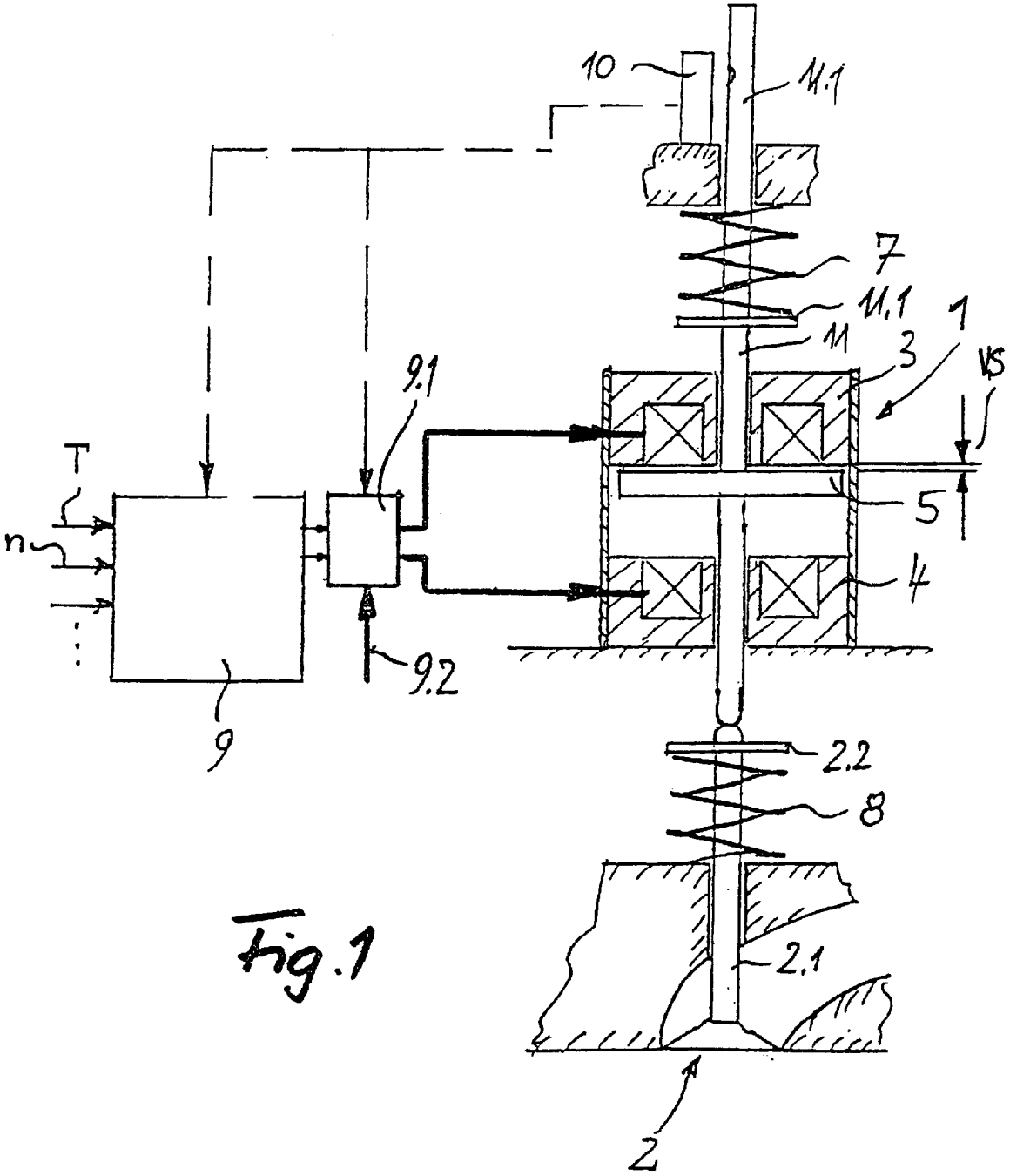

METHOD FOR CONTROLLING THE FINAL POSITION OF A GAS EXCHANGE VALVE ACTUATED BY AN ELECTROMAGNETIC ACTUATOR IN AN INTERNAL COMBUSTION PISTON ENGINE

An electromagnetic actuator for actuating a cylinder valve in a piston-type internal combustion engine essentially consists of two spaced-apart electromagnets with opposite-arranged pole faces, between which an armature acting upon the cylinder valve to be actuated can move back and forth, counter to the force of at least one restoring spring, between an open position and a closed position for the cylinder valve. One of the electromagnets thus functions as closing magnet for holding the cylinder valve in the closed position, counter to the force of an opening spring, while the other electromagnet functions as opening magnet for holding the cylinder valve in the opened position by means of the armature and counter to the force of the associated closing spring.

The arrangement in this case is such that the idle position of the armature is the position in the center between the two pole faces. If current is supplied alternately to the two electromagnets, the armature comes to rest against the pole face of the respective electromagnet under current, thus the catching electromagnet, counter to the force of a restoring spring. If the holding current at the respective holding electromagnet is switched off, the armature is accelerated by the force of the restoring spring in the direction of the respective other electromagnet, which is admitted with a correspondingly high catching current during the armature movement. Thus, once the armature moves past the center position, it comes to rest against the momentarily catching electromagnet as a result of the magnetic force and counter to the force of the associated restoring spring.

The control of the electromagnetic actuator is dependent upon the operating data from the piston-type internal combustion engine that is available to the engine control, essentially involving the load requirement and the speed. For example, if the cylinder valve is in the closed position where the armature rests against the closing magnet, the armature is essentially controlled in dependence on the time, meaning via the engine control and by taking into consideration the crankshaft position and the parameters from the specified load, which respectively define the opening moment and the closing moment for the cylinder valve. The armature movement is started by switching off the relatively low holding current, so that during a predetermined interval after the holding current is switched off, the catching current on the catching electromagnet can be switched on. The time interval for this can be predetermined with the aid of previously obtained empirical data or even theoretical data.

If the catching current is switched on, the magnetic force increases progressively with increasing approach of the armature to the pole face of the catching electromagnet and a constant supply of current, while the opposite directed force of the restoring spring increases only linearly. As a result, the armature movement accelerates during the end phase just prior to the impact with the pole face of the catching electromagnet, thereby leading to a strong impact between armature and pole face. In many respects, this leads to disadvantages, for example by stimulating structure-born sounds and airborne sounds that result in noise development. In order to avoid this, an attempt is made to control the catching current by reducing it shortly before the armature impacts with the pole face of the respective catching electromagnet, wherein the armature approach is detected via a sensor arrangement. The reduction can occur in such a way that when the armature reaches a predetermined position near the pole face, a corresponding control signal is emitted or the armature movement is detected at this close-in range. By way of the engine control or a separate current regulation for the actuator, these approach values can then be used to reduce the catching current in such a way that the armature touches down softly on the pole face with a speed that is only slightly above "zero." The respective electromagnet therefore only needs to be admitted with the low holding current.

However, these known controls are inherently very rigid. On the one hand, they do not take into account the multitude of external interference forces that affect the system consisting of armature and cylinder valve. On the other hand, the noise development is at best minimized, but is not removed.

Thus, it is the object of the invention to create a method, which permits a much more exact control of an electromagnetic actuator and avoids the development of noise.

This object is solved according to the invention with a method for controlling an electromagnetic actuator for actuating a cylinder valve in a piston-type internal combustion engine. The actuator is provided with two spaced-apart electromagnets, between which an armature acting upon the cylinder valve can move back and forth between the pole faces of the two electromagnets, with a predetermined lift between an open position and a closed position of the cylinder valve and counter to the force of at least one restoring spring. A control is used to alternately admit the electromagnets with a catching current, and a sensor arrangement is used to detect the armature lift during its movement from one pole face to another. Thus, the current supply to the armature of the catching electromagnet is triggered via the control and in dependence on the detected actual armature lift values, such that the armature moves with a speed tending toward "zero" at a predetermined distance range to the pole face of the respective catching electromagnet. At the end of the lift, the catching electromagnet is supplied with only enough current for the armature to be held suspended at a short distance in front of the pole face.

In addition to the point in time for switching off the holding current, the expression "actual armature lift values" refers to at least the detection of the respective end position of the armature and, if necessary, the detection of its speed and its acceleration. In addition to detecting the position and depending on the type of sensor arrangement, the speed can be detected directly or can be derived from the derivation of the path based on the time resulting from the position detection, in the same way as for the acceleration.

The term "armature lift" within the meaning of the method according to the invention is defined by the path of the cylinder valve between its closed position and its opened position, that is to say without the armature leaving its support on the cylinder valve shaft because of a valve play. The distance between the two pole faces relative to each other is longer than the armature lift by approximately the measure of a valve play.

By dividing the armature movement into three phases, the physical characteristics of the actuator, meaning its individual mechanical characteristics as well as the characteristics changed by the operation of the piston-type internal combustion engine, are taken into account. During the first phase, the armature movement is only "observed," permitting the detection of the energetic starting position of the armature movement. This position is essentially predetermined through the actual point in time of separation from the pole face, as well as the force of the restoring spring that accelerates the armature on the one hand and the counter-acting frictional forces and gas-pressure forces on the other hand. In the region close to the electromagnet, the energy losses in the mechanical system, caused by the remaining field that is effective in opposite direction, must of necessity be added when the armature separates. These negative electromagnetic force influences can still be minimized by using an armature with low eddy currents and/or by adding a current with a different polarization, which generates a magnetic field that has the effect of rejecting the armature.

However, as soon as the armature has separated noticeably from the pole face of the previously holding electromagnet, it becomes nearly impossible to influence the armature either through supplying a corresponding current to the previously holding electromagnet, or through supplying current at an earlier time to the catching electromagnet with a current intensity that is justifiable with respect to the energy expenditure. The armature reaches its maximum speed when passing through the center position. In that region, outer influences such as the cylinder inside pressure, frictional influences or even actuator parameters can affect the armature movement.

If, as specified in the method according to the invention, the actual armature lift values are detected via the sensor arrangement at least in the respective end position, the current supply for triggering the catching electromagnet can be controlled toward the end of the armature lift, such that during a predetermined distance range, a so-called "target window," the armature moves with a speed tending toward "zero" as well as an acceleration moving toward "zero." At the end of the armature lift, the holding current supply is controlled such that the armature is held suspended, without the armature making contact with the pole face. In addition, the option of an individual adaptation of the current supply to the respective catching electromagnet is provided, taking into account the external interference influences that affect the armature during the movement. It is sufficient in that case if these predetermined values for speed and acceleration are reached at a specifiable, long distance range from the pole face.

The movement phase that starts when the target window is reached is characterized by a low armature speed and a high force effect of the catching magnet. Thus, a controlled guidance of the armature counter to the force of the restoring spring is possible during this phase until the end of the armature lift by controlling the current supply to the catching magnet, thereby ensuring that the armature is preferably held at a short distance to the pole face.

A soft touchdown of the valve on the valve seat is initially made possible through the controlled influencing of the armature movement in the end phase, during the closing movement and with a corresponding adjustment of the armature lift if a valve play exists. Following an at best slight separation of the armature from the valve, the armature itself is then held suspended in front of the pole face of the catching magnet, thereby ensuring that the valve is held with the full force of the closing spring in the closed position on its valve seat.

The current supplied to the electromagnets can respectively be regulated by controlling the voltage present at the catching magnet. Using a voltage control in place of a current control makes it possible to effect the necessary control actions faster and with more accuracy. The current drops relatively slowly even after the voltage is switched off and accordingly increases relatively slowly if a voltage is added. The voltage and current are advantageously supplied by making use of the on-board system for the piston-type internal combustion engine.

The invention is explained in further detail with the aid of schematic drawings, which show in:

FIG. 1 An electromagnetic actuator with block wiring diagram.

Figure 2:
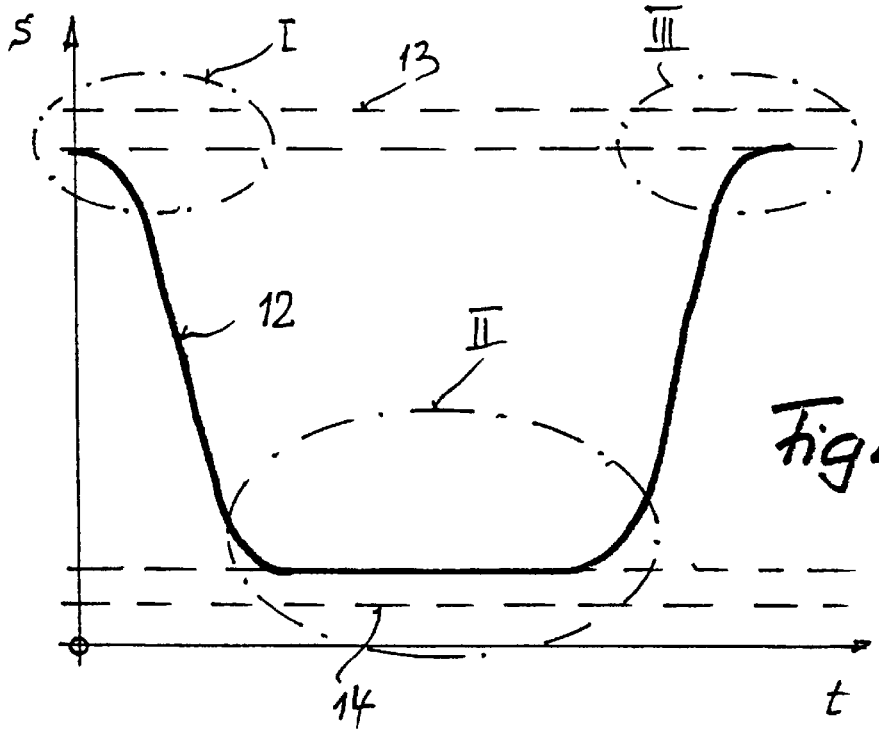

FIG. 2 The armature movement curve in dependence on the time, for a complete actuation cycle.

Figure 3:
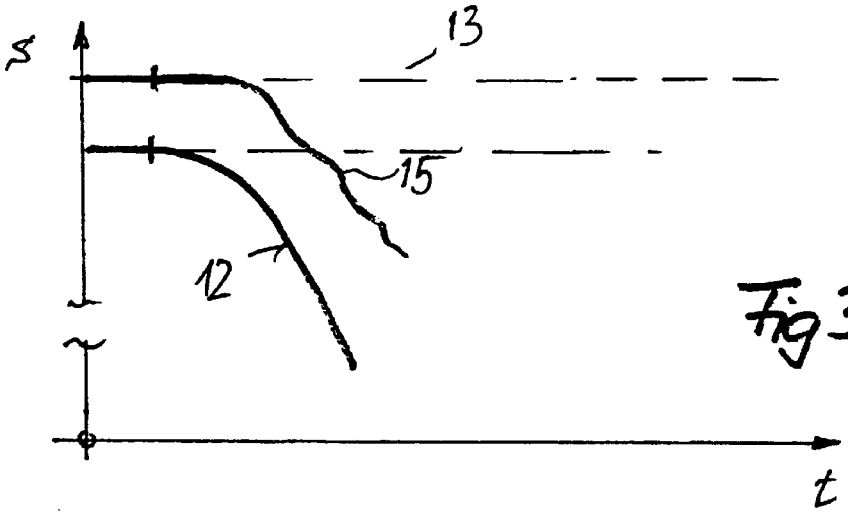

FIG. 3 Lift curves for the start of the opening movement, shown on a larger scale.

Figure 4:
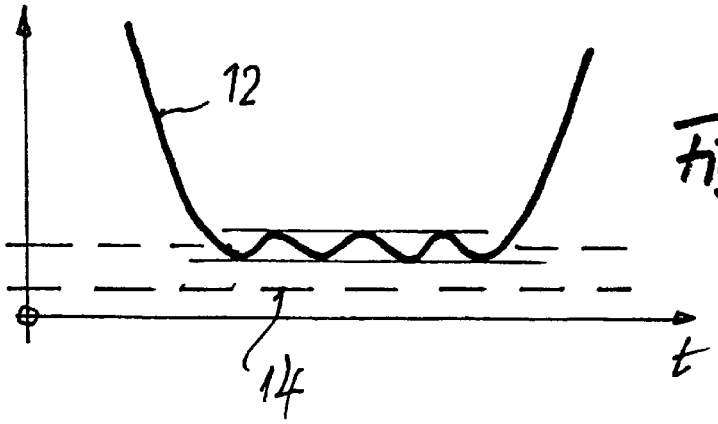

FIG. 4 A lift curve for the open position, shown on a larger scale.

Figure 5:
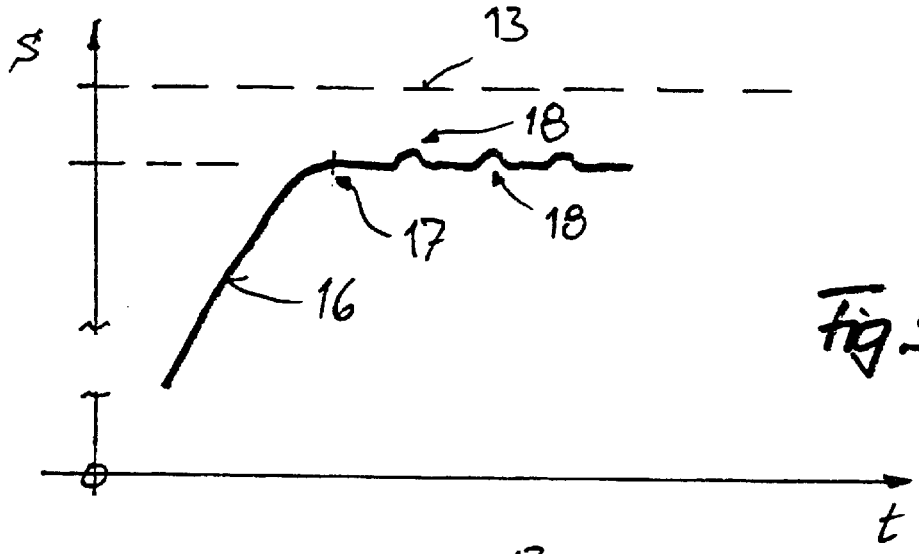

FIG. 5 Lift curves when reaching the closed position, shown on a larger scale.

Figure 6:
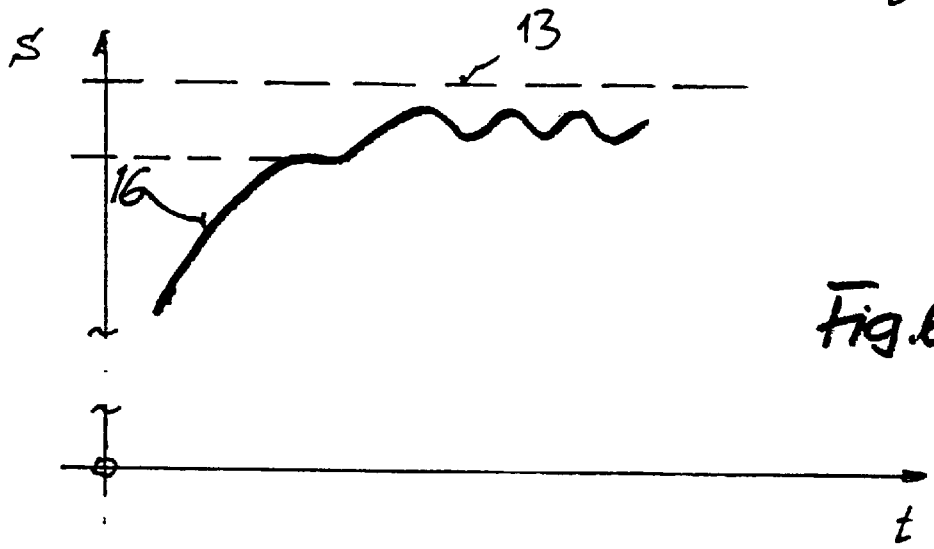

FIG. 6 An armature movement curve for the closed position, with considerable valve play.

Figure 7:
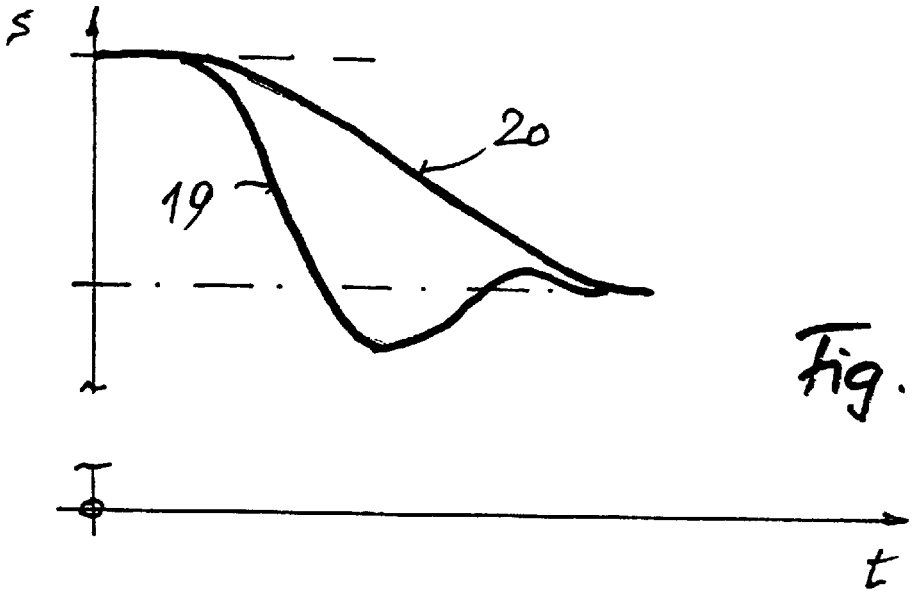

FIG. 7 The lift curve when moving the actuator to the idle position from the closed position.

FIG. 1 shows an electromagnetic actuator 1 for actuating a cylinder valve 2. The actuator essentially comprises a closing magnet 3 and an opening magnet 4, arranged at a distance to each other, between which an armature 5 can be moved back and forth against the force of restoring springs, namely an opening spring 7 and a closing spring 8. In the drawing, the arrangement is shown in the closed position, meaning in the "traditional" arrangement for opening spring and closing spring. With this arrangement, the closing spring 8 has a direct effect via a spring plate 2.2 that is connected to the shaft 2.1 of the cylinder valve 2. The guide rod 11 of armature 5, which can be divided, is separated from the shaft 2.1. A so-called valve play VS exists as a rule. The opening spring 7 in turn supports itself on a spring plate 11.1 on the guide rod 11, so that this guide rod 11 is pushed against the shaft 2.1 of cylinder valve 2 under the effect of the opening spring 7 in the position as shown. The distance VS corresponds to the predetermined region for suspension if the existing valve play is compensated.

It is also possible to provide only a single restoring spring in place of the opening spring 7, which is designed such that a corresponding restoring force is generated each time the armature 5 passes over the center position. A separate closing spring 8 can thus be omitted. With an arrangement of this type, however, the guide rod 11 must be connected to the shaft 2.1 of the cylinder valve via a corresponding coupling element, which transfers the back and forth movement of the armature in the same way to the cylinder valve 2.

The closing spring 8 and the opening spring 7 as a rule are designed such that in the idle position, meaning if no current is supplied to the electromagnets, the armature 5 is positioned in the center. During the start-up, the armature 5 with its cylinder valve 2 must then be stimulated to oscillate from this center position.

A current controller 9.1 that is assigned to the actuator supplies current to the electromagnets 3 and 4 of actuator 1. This current controller is triggered by an electronic engine control 9, in accordance with predetermined control programs and in dependence on operating data supplied to the engine control, such as speed, temperature and the like. While it is possible in principle to provide a central current controller for all actuators in a piston-type internal combustion engine, it is advantageous for the method according to the invention to assign a separate current controller to each actuator. This current controller is connected to a central voltage supply 9.2 and is actuated by the engine control 9.

The actuator 1 is coordinated with a sensor 10, which makes it possible to detect the armature functions. The sensor 10 is shown schematically herein. With a preferred sensor design, the lift of armature 5 is detected, so that the respective armature position can be transmitted to the engine control 9 and/or the current controller 9.1. If necessary, the speed and/or acceleration of the armature can also be determined with corresponding computing operations in the engine control 9 or the current control 9.1. Thus, the current supplied to the two electromagnets 3, 4 during the catching phase and the holding phase can be controlled in dependence on the armature position and/or the armature speed and/or the acceleration.

It is not necessary for the sensor 10 to be assigned to a scanning rod 11.1 that is connected to the armature 5, as shown. It is also possible to assign a correspondingly designed sensor to the side of armature 5 or to arrange sensors of this type in the region of the pole face for the respective electromagnet.

The current controller 9.1 furthermore is provided with corresponding means for detecting current and voltage of the respective electromagnets 3 and 4, as well as for modifying the current curve and the voltage curve. A fully variable control of the actuator 1 for the cylinder valve 2 is then possible via the engine control 9, for example with respect to the start and end of the opening times and in dependence on predetermined operating programs that are supported, if necessary, by corresponding performance characteristics. It is furthermore possible to control the actuation with respect to the height of the opening lift or even the number of opening lifts during the closing time. Also possible are small opening lifts from the closed state, through a "slow suspended" separation and a "slow suspended" touchdown of the valve.

Based on the method according to the invention, the current controller 9.1 controls the current supply to the closing magnet 3 by using an ideal current supply to suspend the armature at a short distance from the pole face of closing magnet 3, such that the armature 5 with its guide rod 11 still makes contact with the shaft 2.1 of the cylinder valve. The magnetic force of closing magnet 3, generated through the supply of holding current, is ideally controlled such that the force tends toward "zero" in the contacting area between guide rod 11 and the valve shaft 2.1. The cylinder valve 2 thus is pressed with the full force of closing spring 8 onto its valve seat. The remaining gap between the pole face of closing magnet 3 and the opposite-arranged surface of armature 5 corresponds in this case approximately to the valve play VS.

The line 12 in FIG. 2 schematically illustrates the armature movement curve over a full movement cycle, relative to the exemplary embodiment shown in FIG. 1.

The fields I, II and III with dotted outlines mark the areas adjacent to the pole faces of the holding closing magnet 3 and to the holding opening magnet 4. These closein areas are shown at an enlarged scale for the explanations provided in FIGS. 3, 4 and 5.

In FIG. 2, the curve 12 represents the lift curve for the armature 5 in dependence on the time for a full valve play, that is to say starting with the closed position shown in FIG. 1 via the opened position and back to the completely closed position. The line 13 characterizes the position of the pole face of closing magnet 3 and the line 14 characterizes the position of the pole face of opening magnet 4. Relative to the lift curve, it is obvious that the holding current supplied to the two electromagnets 3 and 4 is controlled such that the armature 5 is held suspended in front of the respective pole face.

The region given the reference I in FIG. 2 is shown in FIG. 3 on a larger scale. The line 13 in turn shows the position of the pole face for the closing magnet. The curve branch 12 illustrates the movement progression starting with the suspended holding position of the armature after the holding current is switched off. The movement progression shows that once the holding current is switched off, the armature movement starts without adhering time and without superimposed oscillations.

By comparison, the curve branch 15 illustrates the course of the lift distance for armature 5 if the closing magnet 4 is supplied with a high enough current, so that the armature comes to rest against the pole face. Once the holding current is switched off, which occurs at the same time as for the curve 12, the armature is still held by the closing magnet 4 during a so-called adhering time until the force of the magnetic field that decays with a delay is low enough, so that the restoring force of the opening spring 7 is sufficient to move the armature 5. Following an initially extremely high acceleration, the armature with guide rod 11 impacts with the end of valve shaft 2.1, after overcoming the valve play VS. Following an initial rebounding action, the total mass of armature and cylinder valve is then accelerated further, wherein an oscillation remains superimposed on this movement path, depending on the spring-mass ratios.

The region given the reference II in FIG. 2 is shown in FIG. 4 on a larger scale, namely the movement of the armature held suspended in the open position. By controlling the current to hold between a lower and an upper holding current level with a variable frequency based on values predetermined by the controller 9.1 for controlling the suspension and a variable timing ratio, the cylinder valve also oscillates to a slight degree, owing to the resulting holding magnet force that acts pulsating upon the armature 5. In the process, the guide rod 11 makes secure contact with the free end of the valve shaft 2.1 by way of the spring force. This slight back and forth movement of the valve in the open position is not important for the flow actions.

If the holding current to the opening magnet 4 is switched off, the armature 5 initially moves under the force effect of the closing spring 8 once more in the direction of the pole face of the closing magnet 3. Depending on the mode of operation predetermined by the control device, the catching closing magnet 3 is then accordingly supplied with current to overcome the force of opening spring 7, which is effective in the opposite direction once the center position has been passed, owing to a corresponding magnetic force. In that case, the movement is controlled such that following an initial acceleration via a corresponding control of the current supply to the catching closing magnet 3, the speed as well as the acceleration tend toward "zero," in dependence on the armature position detected via the sensor 10. Thus, the armature 5 is again held in a suspended position at a distance to the pole face of closing magnet 3.

Line 16 in FIG. 5 shows the curve for the armature lift until the cylinder valve 2 touches down on its valve seat (point 17). By means of a targeted increase in the holding current level of closing magnet 3, it can be detected via the sensor 10 whether the guide rod 11 is still frictionally connected to the valve shaft 2.1. The frictional connection exists if respective "peaks" 18 only can be recognized as reaction to the current increase, in place of an oscillating movement.

In comparison to FIG. 5, FIG. 6 shows the situation where the guide rod 11 is lifted off the valve shaft 2.1 during an increase in the holding current. Thus, under the influence of the purposely controlled holding current supply, the armature oscillates slightly back and forth in the clearance space predetermined by the valve play, without contacting the pole face (line 13), as is the case for the open position of the valve according to FIG. 4. Given a corresponding control of the holding current supply, a movement curve of this type is always obtained if the existing valve play is large enough, so that during a contact between guide rod 11 and valve shaft 2.1, the air gap existing in the closed position between armature 5 and the pole face of closing magnet 3 requires that an excessively high holding current must be specified.

Since the armature 5 is held only through magnetic force and by means of a controlled holding current supply in the closed position as well as the open position without making contact with the pole face, the above-described method also offers the option of moving the cylinder valves from the respective end positions, either the closed position or the open position, in a "guided" lifting movement toward the center position if that the piston-type internal combustion engine is shut down. This case is illustrated in FIG. 7.

The line 19 in FIG. 7 shows the lift curve when switching off the holding current, which is valid for an armature resting against the pole face of the holding electromagnet as well as an armature held "suspended" at a distance to the pole face of the holding electromagnet. Owing to the fact that after switching off the holding current, the armature 5 is exclusively subjected to the acceleration force of the associated restoring spring, the armature is moved at high speed in the direction of the center position. Initially, it passes this position as a result of the kinetic energy counter to the force of the other restoring spring. The armature and thus also the cylinder valve come to rest only after repeatedly swinging over the center position as a result of the missing magnetic force of the other electromagnet. This repeated swinging over the center position leads to a considerable noise development in the air intake tract as well as the gas outlet tract.

However, if the holding current for the respective holding electromagnet is switched off only briefly or is lowered to cause an acceleration and is then increased to a level below the equilibrium level between spring force and magnetic force in order to dampen the movement, the armature can be moved practically without oscillations from the suspended end position back to the center position, as shown with line 20.

Since the lift movement when reaching the respective end position is controlled via the current controller in such a way that the speed tends toward "zero," and the acceleration switches back and forth between low positive values and low negative values, approximately the same average holding current level is required as the one needed for holding the armature against the pole face in order to maintain the suspended condition of the armature at a short distance to the pole face of the respective holding electromagnet. It makes sense that only the timing of the holding current must be controlled to be variable since the effect of the "adhering force" is omitted.

The lift loss through holding the armature in the suspended condition leads to lower maximum armature speeds, but reduces the separation losses, as described in the above, so that a lower energy absorption is required on the side of the catching electromagnet to reach the same suspended end position.

A one-time absolute assigning of the measured values for the valve play can be used to recalibrate the signal from sensor 10, for example as a function of the temperature. This value is then used to place the relative detection of the lift, as referred to the contact point between valve and armature, into an absolute frame. Alternatively, it is also possible to realize a sensor calibration with the holding current level that adjusts in the suspended condition, since this current level essentially represents a function of the distance between the armature and the pole face in the suspended position.

The point in time and the location for the start of the movement corresponding to the separation from the pole face become fuzzy, owing to the control oscillations that occur in the holding position and the resulting air gaps, which differ in size. However, no delay time fluctuations develop since the current control provides the option of influencing the armature movement time within specific limits by varying the width of the air gap.

Fluctuations in the maximum speed and thus the movement time owing to the "location fuzziness in the end position" can be compensated in the end positions with the known system parameters, for example a corresponding control oscillation characteristic.

What is claimed is:

1. A method for controlling an electromagnetic actuator for actuating a cylinder valve in a piston-type internal combustion engine, said actuator comprising two electromagnets arranged at a distance to each other, between which an armature acting upon the cylinder valve can respectively move back and forth between the pole faces of the two electromagnets and counter to the force of at least one restoring spring, with a predetermined lift defining the open position and the closed position of the cylinder valve, the method comprising the following steps:

(a) alternately energizing the electromagnets with a catching current;

(b) detecting the armature lift by a sensor arrangement during a first phase of movement of the armature from the one pole face to the other pole face;

(c) controlling, as a function of detected actual values for the armature lift, the current supplied to the catching electromagnet such that the armature moves with a speed tending toward "zero" at a predetermined distance to the pole face of the respective catching electromagnet; step (c) being performed during a second phase of armature movement from the one pole face to the other pole face; said second phase being subsequent to said first phase and constituting a target window; and (d) controlling, during armature movement in said target window, the holding current supply of the catching electromagnet such that the armature is held suspended at a short distance from the pole face.

2. A method for controlling an electromagnetic actuator for actuating a cylinder valve in a piston-type internal combustion engine, said actuator comprising two electromagnets arranged at a distance to each other, between which an armature acting upon the cylinder valve can respectively move back and forth between the pole faces of the two electromagnets and counter to the force of at least one restoring spring, with a predetermined lift defining the open position and the closed position of the cylinder valve, the method comprising the following steps:

(a) alternately energizing the electromagnets with a catching current;

(b) detecting the armature lift by a sensor arrangement during movement of the armature from the one pole face to the other pole face;

(c) controlling, as a function of detected actual values for the armature lift, the current supplied to the catching electromagnet such that the armature moves with a speed tending toward "zero" at a predetermined distance to the pole face of the respectively catching electromagnet;

(d) controlling, at the end of the armature lift, the holding current supply of the catching electromagnet such that the armature is held suspended at a short distance from the pole face; and (e) in performing step (d), controlling a level of the holding current between an upper and a lower magnitude such that the resulting pulsating lift movement is within the range specified for a given valve play.

3. A method for controlling an electromagnetic actuator for actuating a cylinder valve in a piston-type internal combustion engine, said actuator comprising two electromagnets arranged at a distance to each other, between which an armature acting upon the cylinder valve can respectively move back and forth between the pole faces of the two electromagnets and counter to the force of at least one restoring spring, with a predetermined lift defining the open position and the closed position of the cylinder valve, the method comprising the following steps:

(a) alternately energizing the electromagnets with a catching current;

(b) detecting the armature lift by a sensor arrangement during movement of the armature from the one pole face to the other pole face;

(c) controlling, as a function of detected actual values for the armature lift, the current supplied to the catching electromagnet such that the armature moves with a speed tending toward "zero" at a predetermined distance to the pole face of the respectively catching electromagnet;

(d) controlling, at the end of the armature lift, the holding current supply of the catching electromagnet such that the armature is held suspended at a short distance from the pole face; and (e) lowering, when shutting down the engine, the holding current level briefly for the separation of the armature and immediately thereafter raising the level just below a current level for an equilibrium of forces between spring force and magnetic force for effecting a drifting of the armature to an armature center position between the pole faces; said center position being defined by the design of the restoring spring.

* * * * *